US008287308B2

(12) United States Patent
Yang et al.

(10) Patent No.: US 8,287,308 B2
(45) Date of Patent: Oct. 16, 2012

(54) QUICK ASSEMBLY LNBF

(75) Inventors: Lan-Chun Yang, Taipei Hsien (TW); Hung-Yuan Lin, Taipei Hsien (TW); San-Yi Kuo, Taipei Hsien (TW)

(73) Assignee: Wistron NeWeb Corporation, Hsi-Chih, Taipei Hsien (TW)

( * ) Notice: Subject to any disclaimer, the term of this patent is extended or adjusted under 35 U.S.C. 154(b) by 451 days.

(21) Appl. No.: 12/756,168

(22) Filed: Apr. 7, 2010

(65) Prior Publication Data

US 2010/0277876 A1 Nov. 4, 2010

(30) Foreign Application Priority Data

May 4, 2009 (TW) ..... 98114684 A

(51) Int. Cl.
*H01R 9/05* (2006.01)

(52) U.S. Cl. ..... 439/578; 343/906; 439/521

(58) Field of Classification Search ..... 439/578–585, 439/519–521, 345, 372–374; 343/878, 904–906
See application file for complete search history.

(56) References Cited

U.S. PATENT DOCUMENTS

| | | | | |
|---|---|---|---|---|
| 5,735,711 | A * | 4/1998 | Fremgen | 439/578 |
| 6,921,293 | B2 * | 7/2005 | Takada et al. | 439/582 |
| 7,385,564 | B2 * | 6/2008 | Zihlman | 343/878 |
| 8,038,473 | B2 * | 10/2011 | Amidon | 439/578 |
| 8,081,133 | B2 * | 12/2011 | Shen | 343/840 |

* cited by examiner

*Primary Examiner* — Khiem Nguyen
(74) *Attorney, Agent, or Firm* — Winston Hsu; Scott Margo

(57) ABSTRACT

A low noise block down-converter with integrated feed (LNBF) capable of being quickly assembled is disclosed, which includes an LNBF main body, a connection portion including at least one LNBF locating hole, a support arm including at least one support arm locating hole, a holder disposed on the support arm including a first holding hole and a second holding hole, an auxiliary shaft including at least one locating protrusion, a spring including a spring body, a first spring arm, a second spring arm, and a pivot for connecting the auxiliary shaft and the spring to the holder, wherein the at least one locating protrusion passes the at least one support arm locating hole and the at least one LNBF locating hole to fix relative position between connection portion and the support arm, and the spring positions the at least one locating protrusion in an engaging state with elastic restoring force.

20 Claims, 13 Drawing Sheets

QUICK ASSEMBLY LNBF

BACKGROUND OF THE INVENTION

1. Field of the Invention

The present invention relates to a low noise block down-converter with integrated feed (LNBF), and more particularly, to an LNBF capable of being quickly assembled.

2. Description of the Prior Art

Satellite communication technology has advantages of wide coverage area and long distance linking, which is applied in many areas, such as in satellite broadcasts or communication systems. Thus, wherever you are (even on the ocean or in the desert), the satellite signal may be received by a corresponding antenna. Please refer to FIG. 1. FIG. 1 is a satellite communication receiving system 10 in the prior art. The satellite communication receiving system 10 includes a dish antenna 102, a Low Noise Block Down-converter with Integrated Feed (LNBF) 104, and a support arm 106. In the satellite communication receiving system 10, the paraboloid dish antenna 102 reflects the satellite signal onto the LNBF 104 located on the focal point of the dish antenna 102. The satellite signal is down converted to an intermediate frequency (IF) signal by the LNBF. After that, the IF signals are fed to a rear satellite receiver via coaxial cables for further process. The support arm 106 is utilized for supporting the LNBF 104 and containing the coaxial cables. In practice, the dish antenna 102 and the LNBF 104 are usually placed outdoors in order to receive the satellite signal.

In general, the LNBF 104 and the support arm 106 are usually assembled in the field, and need to be used in an outdoor environment for various weather conditions. Therefore, as shown in FIG. 2, if a gap between the LNBF 104 and the support arm 106 is too large, the receiving performance of the satellite signal will be affected. In the prior art, a common method for assembly utilizes lockup screws for fastening the LNBF 104 and the support arm 106. However, the mentioned method may reduce assembly efficiency due to its complicated lockup process. Also, when the assembly environment is in a high place, the worker needs to use tools to complete the assembly process on a ladder, and the worker will be in a dangerous situation.

SUMMARY OF THE INVENTION

It is therefore a primary objective of the claimed invention to provide a low noise block down-converter with integrated feed (LNBF) capable of being quickly assembled.

An embodiment of the invention discloses a low noise block down-converter with integrated feed (LNBF) capable of being quickly assembled, which includes an LNBF main body; a connection portion extending from the LNBF main body, wherein the connection portion comprises a plurality of signal output units and at least one LNBF locating hole; a support arm comprising at least one support arm locating hole and a chamber capable of accommodating the connection portion for supporting the LNBF main body by connecting with the connection portion; a holder disposed on the support arm comprising a first holding hole and a second holding hole; an auxiliary shaft comprising a third holding hole and at least one locating protrusion; a spring comprising a spring body, a first spring arm, and a second spring arm, wherein the first spring arm and the second spring arm are connected to the auxiliary shaft and the holder respectively; and a pivot for connecting the auxiliary shaft and the spring to the holder bypassing through the first holding hole, the second holding hole, the third holding hole, and the spring body; wherein when the connection portion inserts into the chamber of the support arm, the at least one locating protrusion passes the at least one support arm locating hole and the at least one LNBF locating hole to fix relative position between the connection portion and the support arm, and the spring positions the at least one locating protrusion in an engaging state with elastic restoring force.

An embodiment of the invention further discloses a low noise block down-converter with integrated feed (LNBF) capable of being quickly assembled, which includes: an LNBF main body; a connection portion extending from the LNBF main body, wherein the connection portion comprises a plurality of signal output units and at least one LNBF locating hole; a support arm comprising at least one support arm locating hole and a chamber capable of accommodating the connection portion for supporting the LNBF main body by connecting with the connection portion; a holder comprising a first holding hole and a second holding hole; an operating shaft comprising a first end, a second end, and a third holding hole, wherein the first end forms an eccentric cam and the second end is utilized for rotating the operating shaft; a pivot for connecting the operating shaft to the holder bypassing through the first holding hole, the second holding hole, and the third holding hole; and an active plate disposed between the operating shaft and the support arm for contacting with perimeter of the first end of the operating shaft, wherein the active plate comprises at least one locating protrusion; wherein when the connection portion is inserted into the chamber of the support arm, the operating shaft is rotated to make the at least one locating protrusion pass the at least one support arm locating hole and the at least one LNBF locating hole to fix relative position between the connection portion and the support arm.

An embodiment of the invention further discloses a low noise block down-converter with integrated feed (LNBF) capable of being quickly assembled, which includes: an LNBF main body; a connection portion extending from the LNBF main body, wherein the connection portion comprises a plurality of signal output units and at least one LNBF locating hole; a support arm comprising at least one support arm locating hole and a chamber capable of accommodating the connection portion for supporting the LNBF main body by connecting with the connection portion; and at least one elastic tenon, wherein each of the at least one elastic tenon includes an elastic tenon sleeve comprising an opening; a tenon elastomer disposed in the elastic tenon sleeve; and a locating tenon disposed in the elastic tenon sleeve and connected to the tenon elastomer; wherein when the connection portion is inserted into the chamber of the support arm, the at least one elastic tenon passes the at least one support arm locating hole and the at least one LNBF locating hole to fix relative position between the connection portion and the support arm, and the corresponding tenon elastomer makes the at least one elastic tenon in an engaging state with elastic restoring force.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
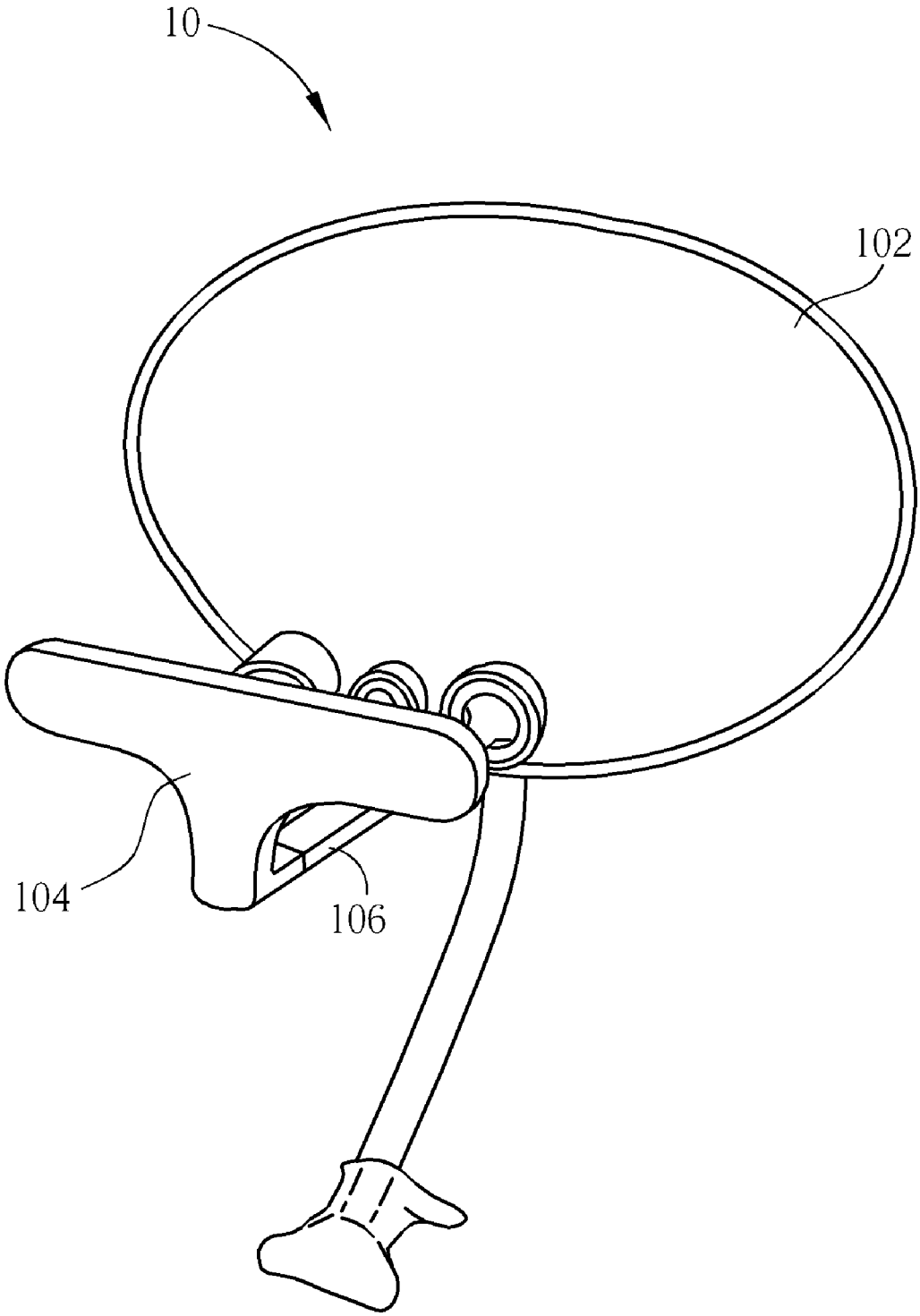
FIG. 1 PRIOR ART
FIG. 1 is a satellite communication receiving system in the prior art.
Figure 2:
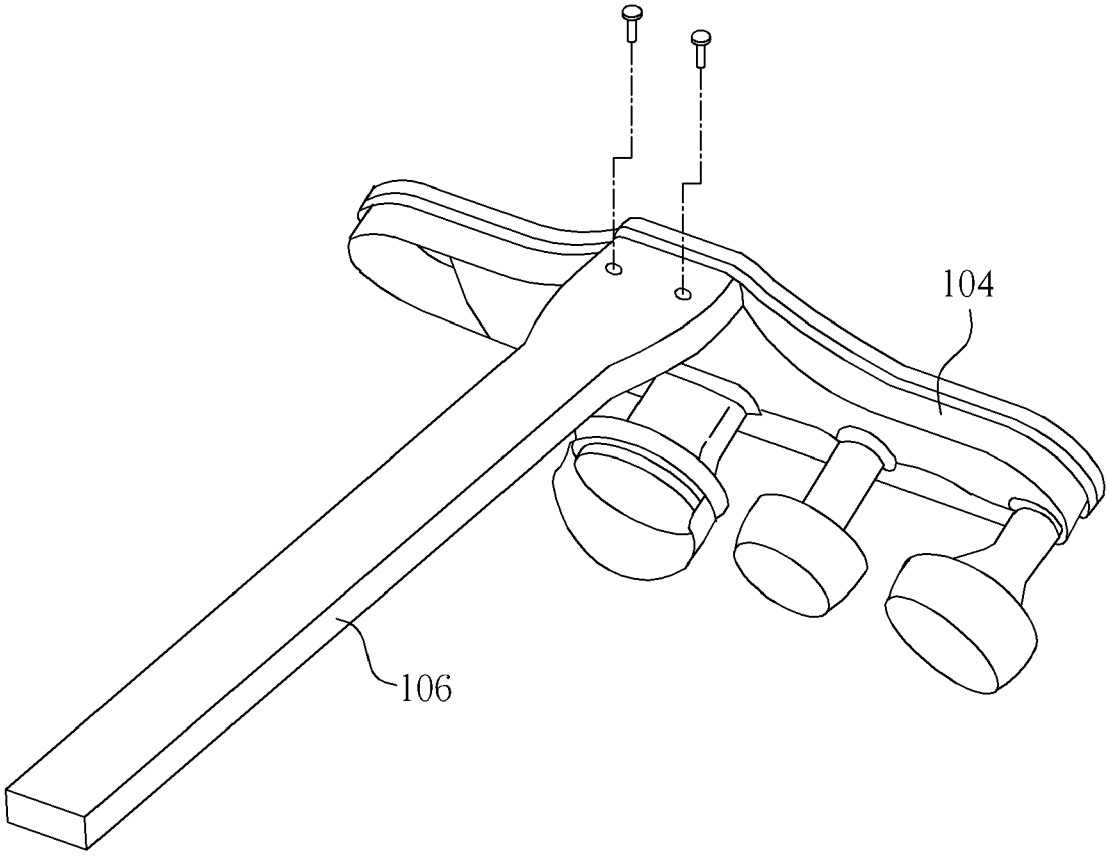
FIG. 2 PRIOR ART
FIG. 2 is a schematic diagram of an LNBF by using screws in the prior art.
Figure 3:
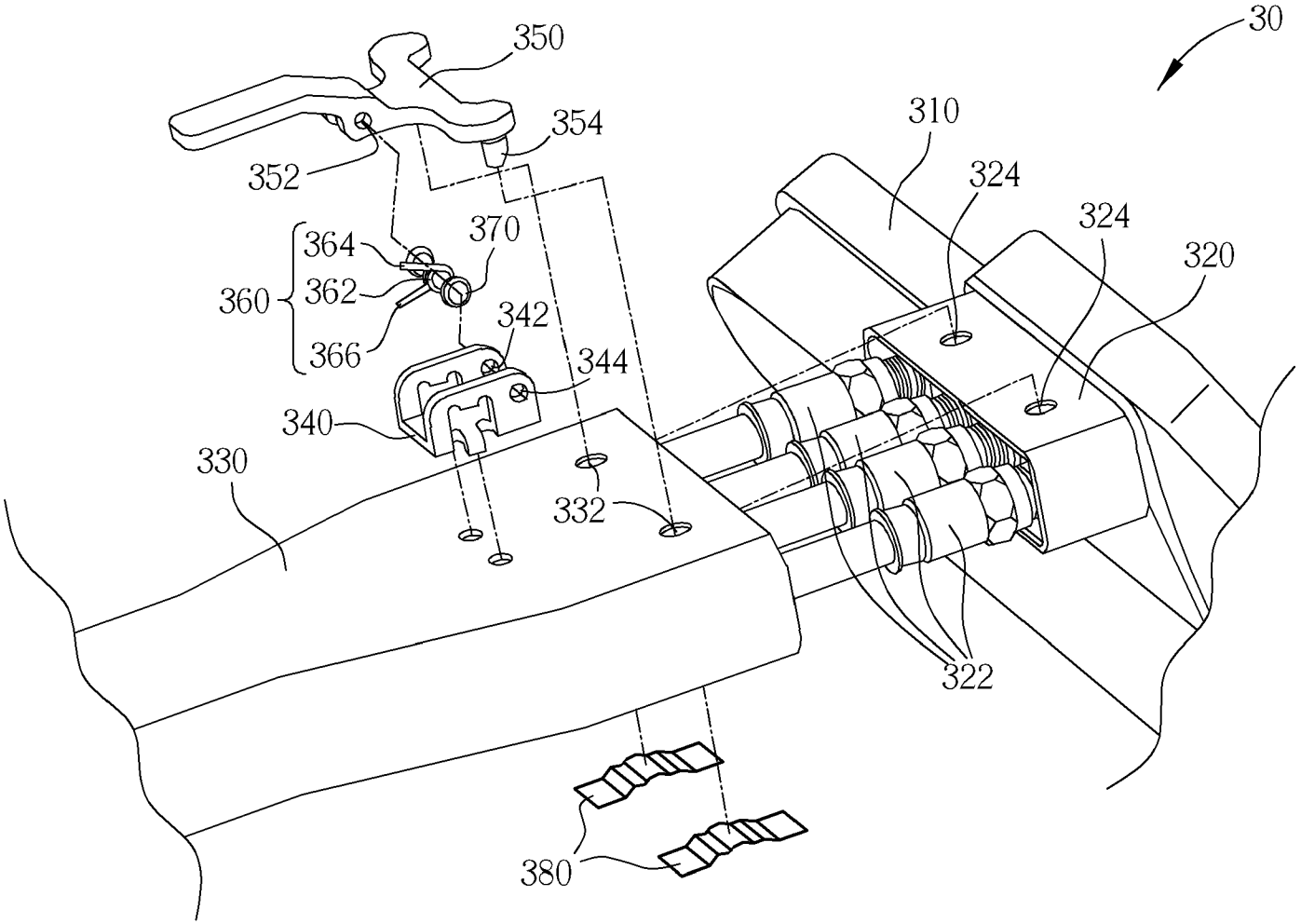
FIG. 3 is an exploded diagram of an LNBF capable of being quickly assembled according to an embodiment of the invention.

Please refer to FIG. 3. FIG. 3 is an exploded diagram of a low noise block down-converter with integrated feed (LNBF) 30 capable of being quickly assembled according to an embodiment of the invention. The LNBF 30 includes an LNBF main body 310, a connection portion 320, a support arm 330, a holder 340, an auxiliary shaft 350, a spring 360, a pivot 370, and fixing spring pieces 380. The LNBF main body 310 is connected to the support arm 330 via the connection portion 320 for securely fixing at a focal point of the paraboloid satellite dish. The connection portion 320 extends from the LNBF main body 310, which includes a plurality of signal output units 322 and LNBF locating holes 324. The support arm 330 includes support arm locating holes 332 and a chamber 334 capable of accommodating the connection portion 320. The support arm 330 is utilized for supporting the LNBF main body 310 by connecting to the connection portion 320. The holder 340 is disposed on the support arm 330, which includes a first holding hole 342 and a second holding hole 344. The auxiliary shaft 350 includes a third holding hole 352 and locating protrusions 354. The spring 360 includes a spring body 362, a first spring arm 364, and a second spring arm 366, of which the first spring arm 364 and the second spring arm 366 are connected to the auxiliary shaft 350 and the holder 340 respectively, so that the spring body 362 provides elastic restoring force to the auxiliary shaft 350 and the holder 340. The pivot 370 is utilized for connecting the auxiliary shaft 350 and the spring 360 to the holder 340 by passing through the first holding hole 342, the second holding hole 344, the third holding hole 352, and the spring body 362. Therefore, when the connection portion 320 is inserted into the chamber 334, the locating protrusions 354 can pass the support arm locating holes 332 and the LNBF locating holes 324 to fix relative position between the connection portion 320 and the support arm 330, and the spring 360 can also position the locating protrusions 324 in an engaging state with elastic restoring force. On the other hand, the fixing spring pieces 380 are disposed on a lateral wall of the chamber 334 for providing elastic restoring force to the connection portion 320 to fix relative position between the connection portion 320 and the support arm 330. In other words, the invention can fix relative position between the connection portion 320 and the support arm 330 via the locating protrusions 354, and use the fixing spring pieces 380 to reduce a gap between the connection portion 320 and the support arm 330, so as to make the connection between the connection portion 320 and the support arm 330 more firm. In addition, the holder 340 can be disposed on the support arm 330 with soldering, engaging, detachable or any other fixing method. Besides, the holder 340 and the support arm 330 can also be formed as a monolithic structure.

Figure 4:
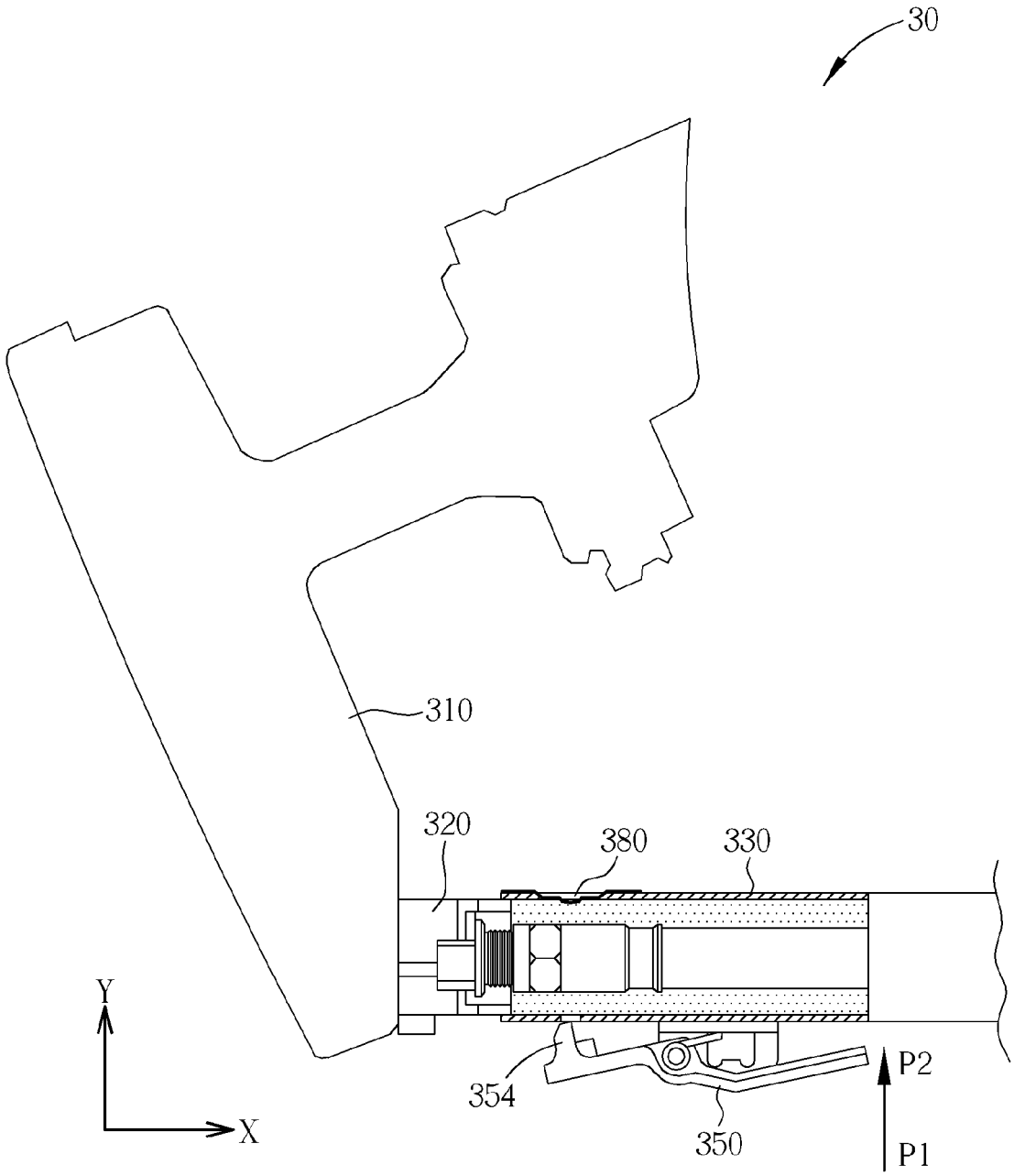
FIG. 4 is a side-view diagram of the connection portion and the support arm shown in FIG. 3 before they are connected.
Figure 5:
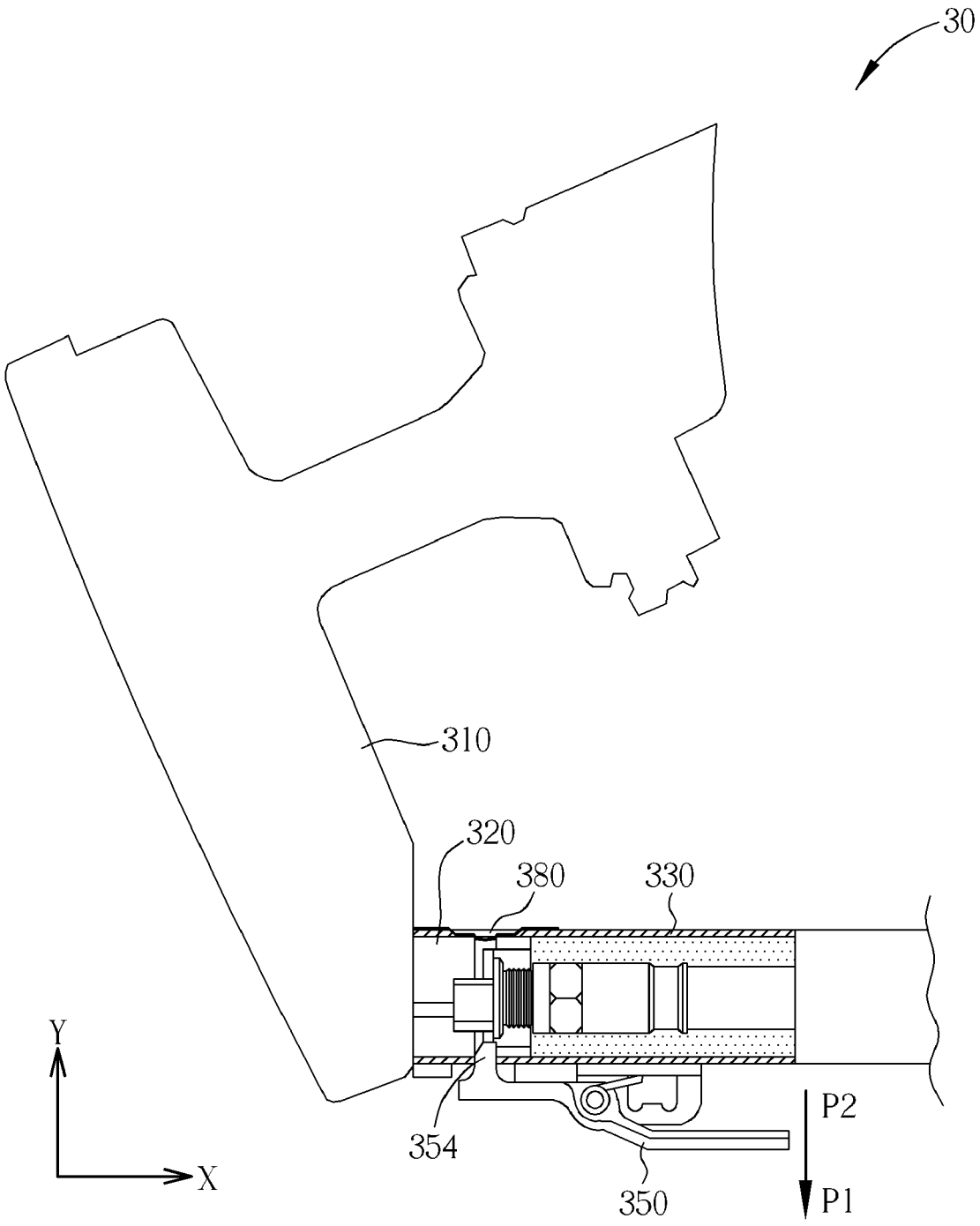
FIG. 5 is a side-view diagram of the connection portion and the support arm shown in FIG. 3 after they are connected.

Further description associated with the assembly and disassembly of the connection portion 320 and the support arm 330 shown in FIG. 3 follows. Please refer to FIG. 4 and FIG. 5. FIG. 4 is a side-view diagram of the connection portion 320 and the support arm 330 shown in FIG. 3 before they are connected. FIG. 5 is a side-view diagram of the connection portion 320 and the support arm 330 shown in FIG. 3 after they are connected. First, while assembling the connection portion 320 and the support arm 330, a user can rotate the auxiliary shaft 350 from a first position P1 to a second position P2 to make the locating protrusions 354 leave the support arm locating holes 332. After that, the connection portion 320 can be inserted into the chamber 334 of the support arm 330 (i.e. the connection portion 320 can be moved forward along the X-axis direction shown in FIG. 3). Next, the user can release the auxiliary shaft 350 after the LNBF locating holes 324 are aligned with the support arm locating holes 332, so that the auxiliary shaft 350 can be rotated from the second position P2 to the first position P1 by elastic restoring force of the spring 360 to make the locating protrusions 354 pass through the support arm locating holes 332 and the LNBF locating holes 324 for fixing relative position between the connection portion 320 and the support arm 330. Regarding disassembly of the connection portion 320 and the support arm 330, please further refer to FIG. 5. As can be seen from above, the user can rotate the auxiliary shaft 350 from the first position P1 to the second position P2 to make the locating protrusions 354 leave the support arm locating holes 332, and remove the connection portion 320 from the chamber 334, and the connection portion 320 can be removed from the support arm 330. As a result, the invention provides methods for assembling and disassembling LNBF components rapidly and securely by simple operation of the auxiliary shaft 350.

Figure 6:
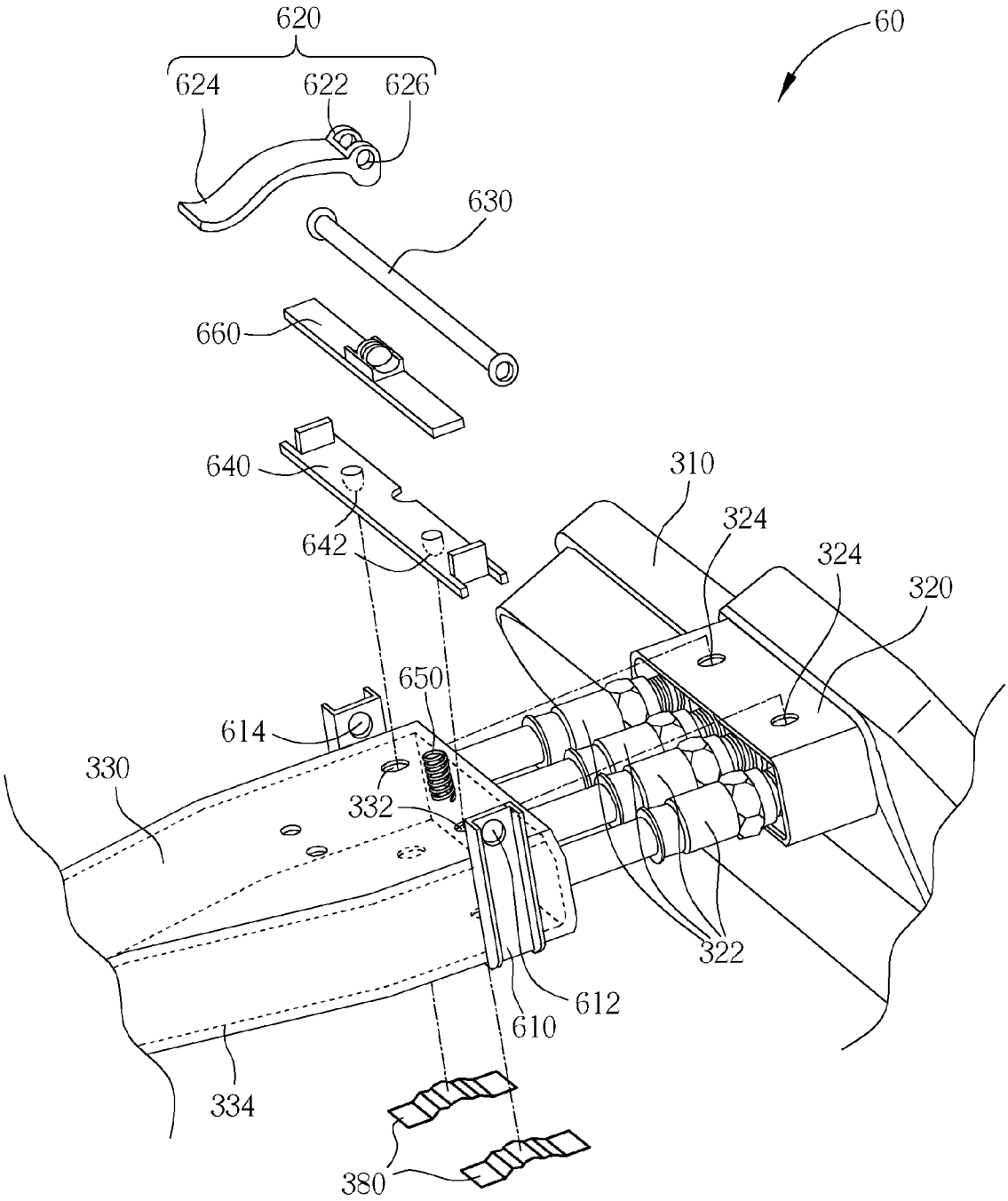
FIG. 6 is an exploded diagram of an LNBF capable of being quickly assembled according to an embodiment of the invention.

Please refer to FIG. 6. FIG. 6 is an exploded diagram of a LNBF 60 capable of being quickly assembled according to an embodiment of the invention. The LNBF 60 includes an LNBF main body 310, a connection portion 320, a support arm 330, a holder 610, an operating shaft 620, a pivot 630, an active plate 640, and fixing spring pieces 380. Please note that the units in the LNBF 60 shown in FIG. 6 with the same designations as those in the LNBF 30 shown in FIG. 3 have similar operations and functions, and further description is omitted for brevity. The interconnections of the units are as shown in FIG. 6. The holder 610 includes a first holding hole 612 and a second holding hole 614. The operating shaft 620 includes a first end 622, a second end 624, and a third holding hole 626. The first end 622 forms an eccentric cam and the second end 624 is utilized for rotating the operating shaft 620. The pivot 630 is utilized for connecting the operating shaft 620 to the holder 610 by passing through the first holding hole 612, the second holding hole 614, and the third holding hole 626. The active plate 640 is disposed between the operating shaft 620 and the support arm 330, which includes locating protrusions 642. The active plate 640 contacts with the perimeter of the first end 622 of the operating shaft 620. In such a condition, according to an operation principle of the eccentric cam, the active plate 640 has various displacements by following the contacting condition with the first end 622 of the operating shaft 620 so as to control position of the locating protrusion 642. When the connection portion 320 is to be inserted into the chamber of the support arm, a user can rotate the operating shaft 620 to make the active plate 640 change places, so that the locating protrusions 642 can pass the support arm locating holes 332 and the LNBF locating holes 324 to fix relative position between the connection portion 320 and the support arm 330. On the other hand, in the LNBF 60, the fixing spring piece 380 can be disposed on a lateral wall of the chamber 334 for providing elastic restoring force to the connection portion 320 to fix relative position between the connection portion 320 and the support arm 330. In such a manner, the invention can fix relative position between the connection portion 320 and the support arm 330 via the locating protrusions 542, and use the fixing spring pieces 380 to reduce the gap between the connection portion 320 and the support arm 330, so as to make the connection between the connection portion 320 and the support arm 330 more firm.

Preferably, the LNBF 60 further includes an elastomer 650. The elastomer 650 is connected between the active plate 640 and the support arm 330 for forcing the active plate 640 away from the support arm 330 through its elastic restoring force. In other words, a user needs to apply force to the active plate 640, and the force must be larger than the elastic restoring force of the elastomer 650 to prevent the active plate 640 from incorrect operation to make the locating protrusions 642 pass through the support arm locating holes 332 and the LNBF locating holes 324, stopping the relative motion of the connection portion 320 and the support arm 330.

The elastomer 650 can be a spring, a spring piece, or any other apparatus having elastic restoring force. The LNBF 60 further includes a protection plate 660. The protection plate 660 is connected between the operating shaft 620 and the active plate 640 for preventing the operating shaft 620 from damaging the active plate 640 while operating. For example, the protection plate 660 can be a plastic thin slice, and should not be a limitation of the invention. In addition, the holder 610 can be a U-shaped holder and formed around the support arm 330 for supporting the operating shaft 620 firmly. The holder 610 can be disposed on the support arm 330 with soldering, engaging, detachable or any other fixing method. For example, the holder 610 can be fixed on the surrounding of the support arm 330 by spot welding or soldering method. Besides, the holder 610 and the support arm 330 can be monolithically formed together.

Figure 7:
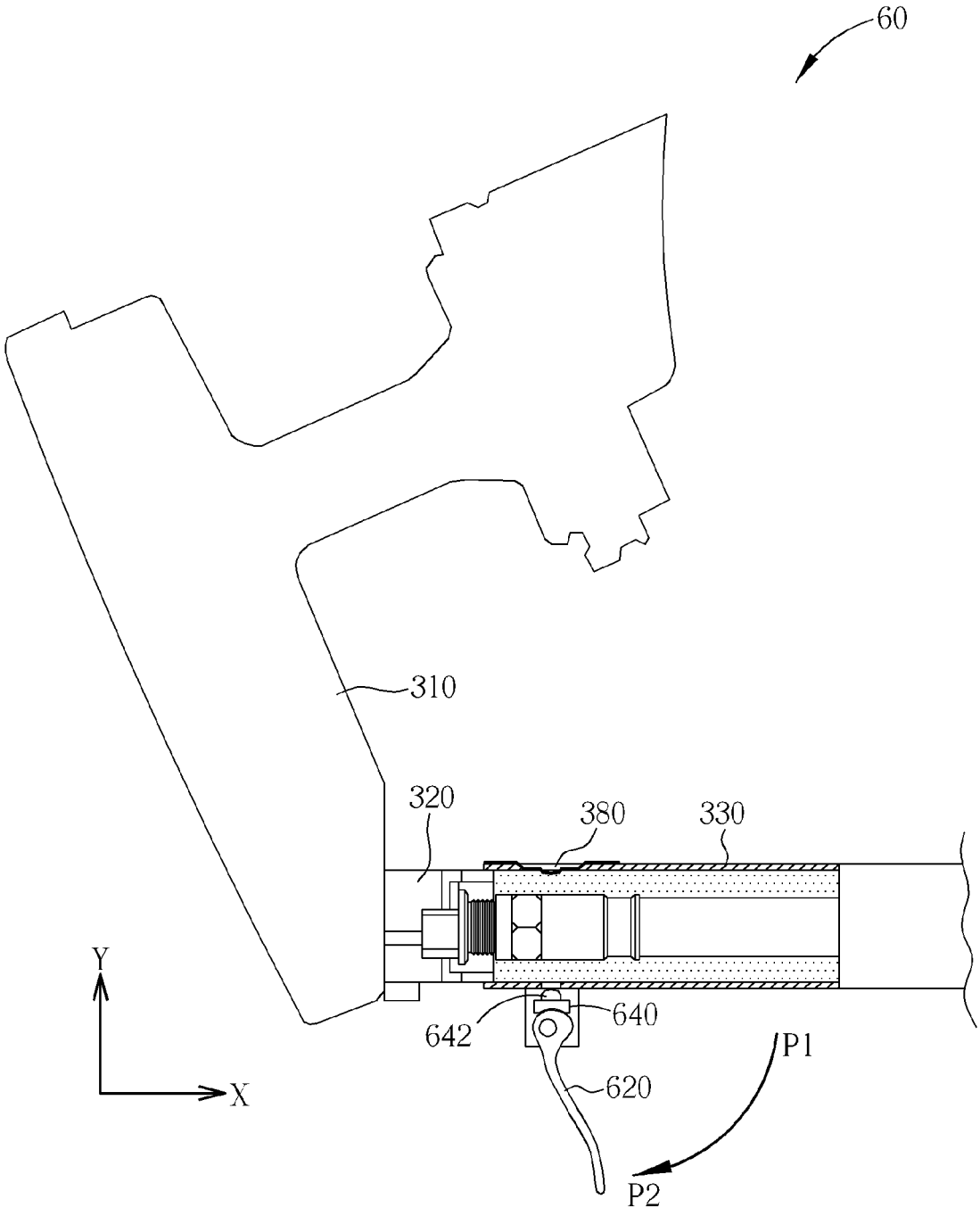
FIG. 7 is a side-view diagram of the connection portion and the support arm shown in FIG. 6 before they are connected.
Figure 8:
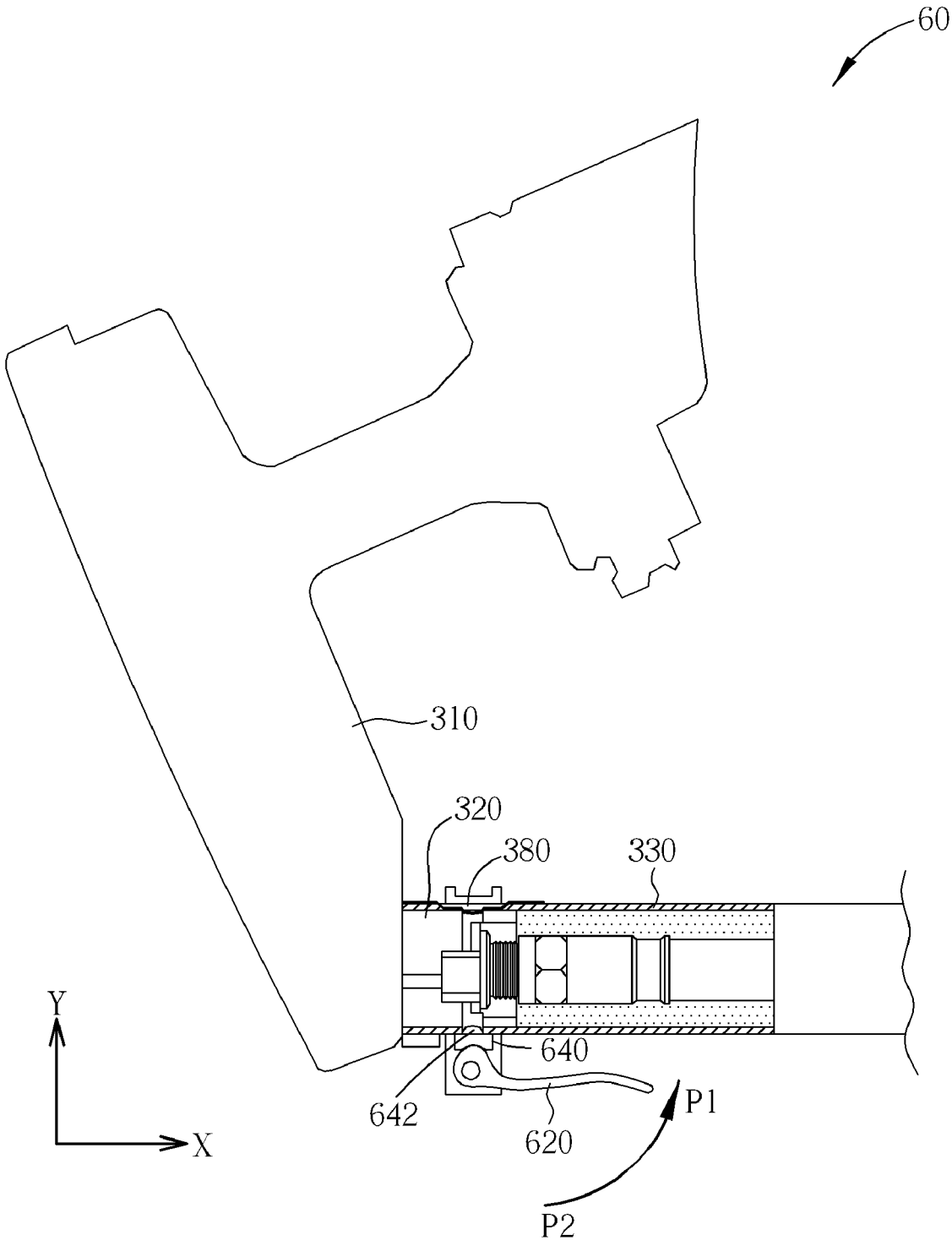
FIG. 8 is a side-view diagram of the connection portion and the support arm shown in FIG. 6 after they are connected.

Further description associated with the assembly and disassembly of the connection portion 320 and the support arm 330 shown in FIG. 6 follows. Please refer to FIG. 7 and FIG. 8. FIG. 7 is a side-view diagram of the connection portion 320 and the support arm 330 shown in FIG. 6 before they are connected. FIG. 8 is a side-view diagram of the connection portion 320 and the support arm 330 shown in FIG. 6 after they are connected. First, while assembling the connection portion 320 and the support arm 330, a user can rotate the operating shaft 620 from a first position P1 to a second position P2 to make the locating protrusions 642 leave the support arm locating holes 332 (i.e. the wall thinness portion of the first end 622 contacts the active plate 640 so that the displacement of the active plate 640 toward the Y-axis direction shown in FIG. 7 becomes decreasing). After that, the connection portion 320 can be inserted into the chamber 334 of the support arm 330 (i.e. the connection portion 320 can be moved forward along the X-axis direction shown in FIG. 7). Next, the user can rotate the operating shaft 620 from the second position P2 to the first position P1 (i.e. the wall thickness portion of the first end 622 contacts the active plate 640 so that the displacement of the active plate 640 toward Y-axis direction shown in FIG. 7 becomes increasing) after the LNBF locating holes 324 are aligned with the support arm locating holes 332 to make the locating protrusions 642 pass through the support arm locating holes 332 and the LNBF locating holes 324 for fixing relative position between the connection portion 320 and the support arm 330. Regarding disassembly of the connection portion 320 and the support arm 330, please further refer to the FIG. 8. As mentioned above, the user can rotate the operating shaft 620 from the first position P1 to the second position P2 to make the locating protrusion 642 leave the support arm locating hole 332, and the connection portion 320 is removed from the chamber 334. As a result, the invention can assemble and disassemble LNBF's components rapidly and securely by simply operating the operating shaft 620 having the eccentric cam design.

Figure 9:
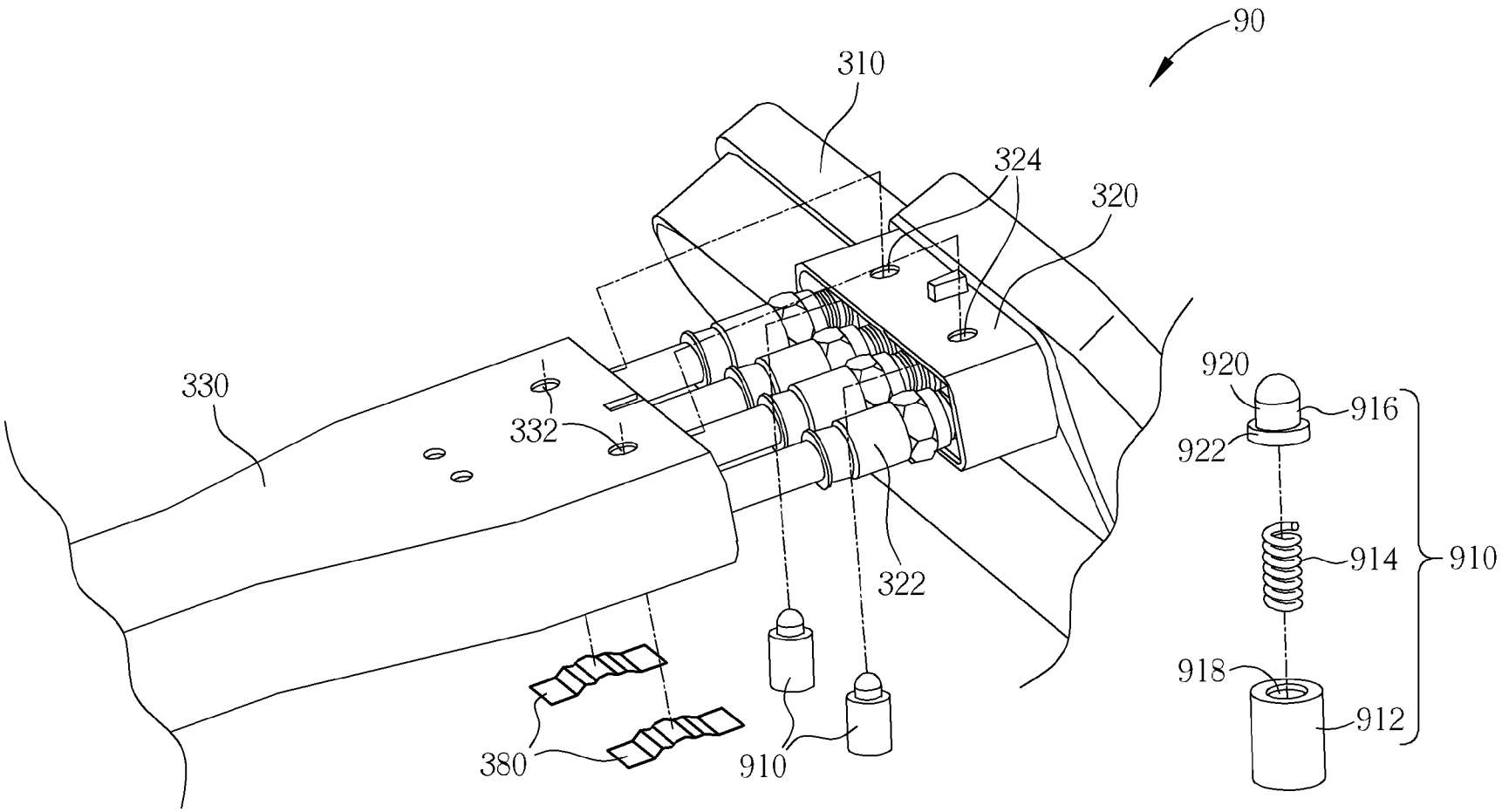
FIG. 9 is an exploded diagram of an LNBF capable of being quickly assembled according to an embodiment of the invention.

Please refer to FIG. 9. FIG. 9 is an exploded diagram of a LNBF 90 capable of being quickly assembled according to an embodiment of the invention. The LNBF 90 includes an LNBF main body 310, a connection portion 320, a support arm 330, fixing spring pieces 380, and elastic tenons 910. Please note that the units in the LNBF 90 shown in FIG. 9 with the same designations as those in the LNBF 30, 60 shown in FIG. 3 and FIG. 6 have similar operations and functions, and further description is omitted for brevity. The interconnections of the units are as shown in FIG. 9. As shown in FIG. 9, each of the elastic tenons 910 includes an elastic tenon sleeve 912, a tenon elastomer 914, and a locating tenon 916. The elastic tenon sleeve 912 includes an opening 918. The tenon elastomer 914 is disposed in the elastic tenon sleeve 912. The locating tenon 916 is disposed in the elastic tenon sleeve 912 and connected to the tenon elastomer 914. The locating tenon 916 includes a protruding portion 920 and a position-limiting portion 922. The protruding portion 920 protrudes from the elastic tenon sleeve 912 through the opening 918. The position-limiting portion 922 is disposed in the elastic tenon sleeve 912 and its surface area is greater than the opening 918 so as to prevent the locating tenon 916 from leaving the corresponding elastic tenon sleeve 912. In such a condition, when the connection portion 320 is inserted into the chamber 334 of the support arm 330, the invention can use the elastic tenon 916 to pass through the support arm locating hole 332 and the LNBF locating hole 324 to fix relative position between the connection portion 320 and the support arm 330, and the corresponding tenon elastomer 914 can put the elastic tenon 916 in an engaging state with its elastic restoring force. Preferably, each component of the elastic tenons 910 can be preassembled before the elastic tenons 910 is disposed in the connection portion 320. The opening 918 of the elastic tenon 910 also levels at the corresponding LNBF locating hole 324. The tenon elastomer 914 can be a spring, a spring piece, or any other apparatus having elastic restoring force. On the other hand, in the LNBF 90, the fixing spring piece 380 can be disposed on a lateral wall of the chamber 334 for providing elastic restoring force to the connection portion 320 to fix relative position between the connection portion 320 and the support arm 330. In such a manner, the invention can fix relative position between the connection portion 320 and the support arm 330 via the elastic tenons 910, and use the fixing spring pieces 380 to reduce the gap between the connection portion 320 and the support arm 330, so as to make the connection between the connection portion 320 and the support arm 330 more firm.

Figure 10:
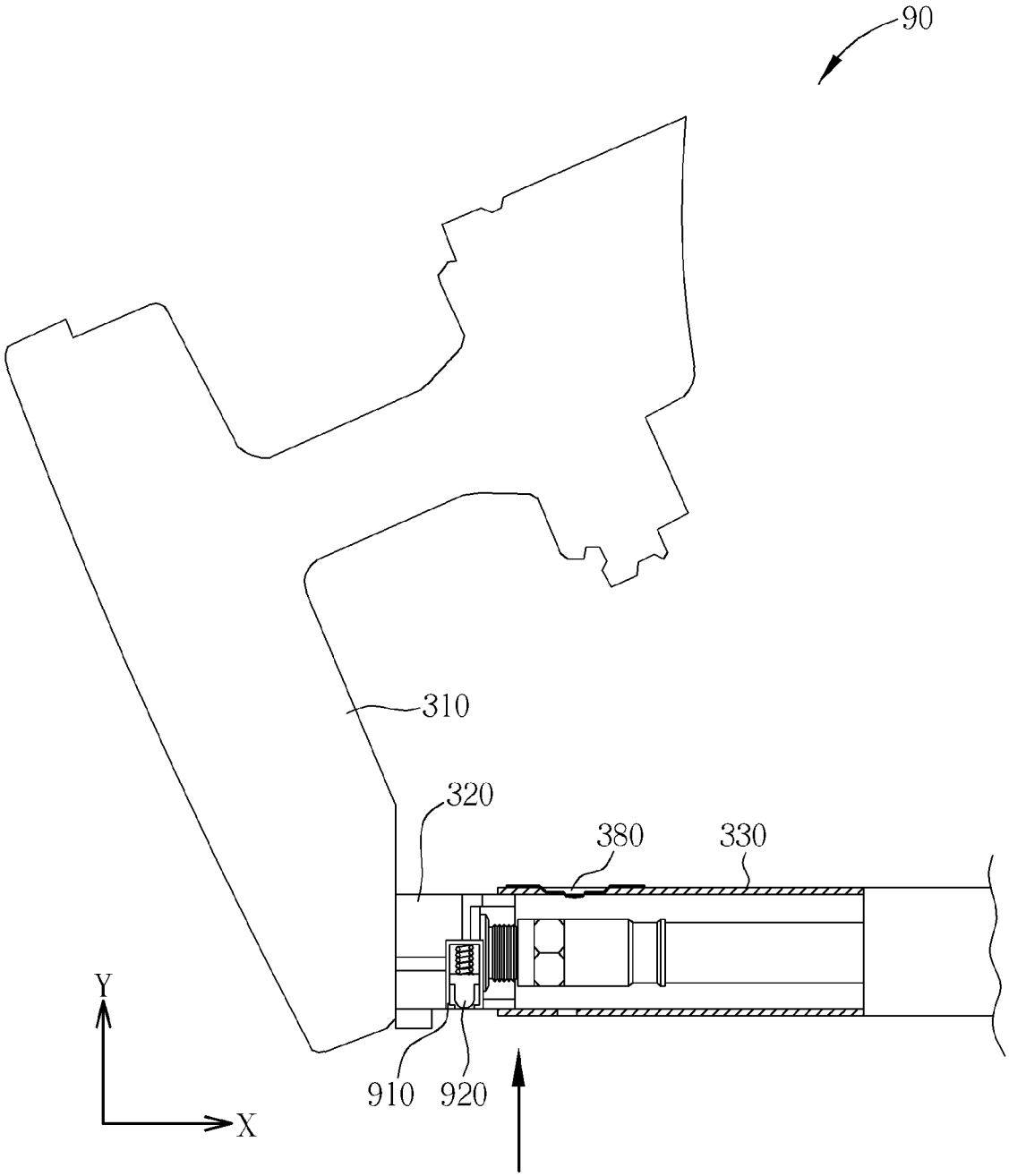
FIG. 10 is a side-view diagram of the connection portion and the support arm shown in FIG. 9 before they are connected.
Figure 11:
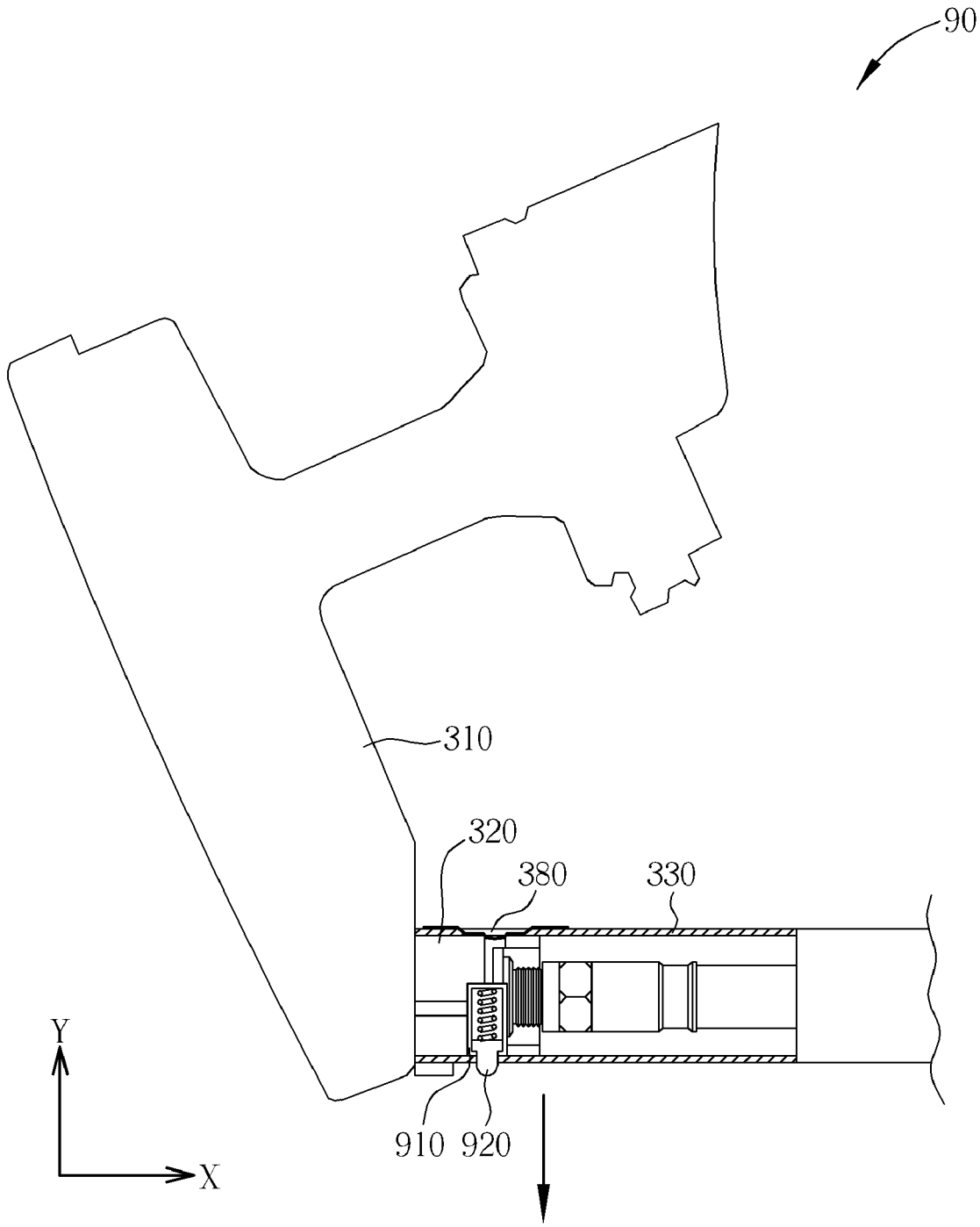
FIG. 11 is a side-view diagram of the connection portion and the support arm shown in FIG. 9 after they are connected.

Further description associated with the assembly and disassembly of the connection portion 320 and the support arm 330 shown in FIG. 9 follows. Please refer to FIG. 10 and FIG. 11. FIG. 10 is a side-view diagram of the connection portion 320 and the support arm 330 shown in FIG. 9 before they are connected. FIG. 11 is a side-view diagram of the connection portion 320 and the support arm 330 shown in FIG. 9 after they are connected. First, while assembling the connection portion 320 and the support arm 330, a user can press the protruding portion 920 of the locating tenon 910 into the elastic tenon sleeve 912. After that, the connection portion 320 can be inserted into the chamber 334 of the support arm 330. Next, the protruding portion 920 of the locating tenon 910 can protrude from the elastic tenon sleeve 912 through the opening 918 by elastic restoring force of the tenon elastomer 914, and passes through the support arm locating hole 332 and the LNBF locating hole 324 for fixing relative position between the connection portion and the support arm after the LNBF locating holes 324 is aligned with the support arm locating holes 332. Regarding disassembly of the connection portion 320 and the support arm 330, please further refer to the FIG. 11. As mentioned above, a user can press the protruding portion 920 of the locating tenon 910 to make the protruding portion 920 leave the support arm locating hole 332 and shrink into the elastic tenon sleeve 912, and the connection portion 320 can be removed from the chamber 334. As a result, the invention provides rapid and secure assembly and disassembly of the LNBF's components by simple operation of the locating tenon 910.

Figure 12:
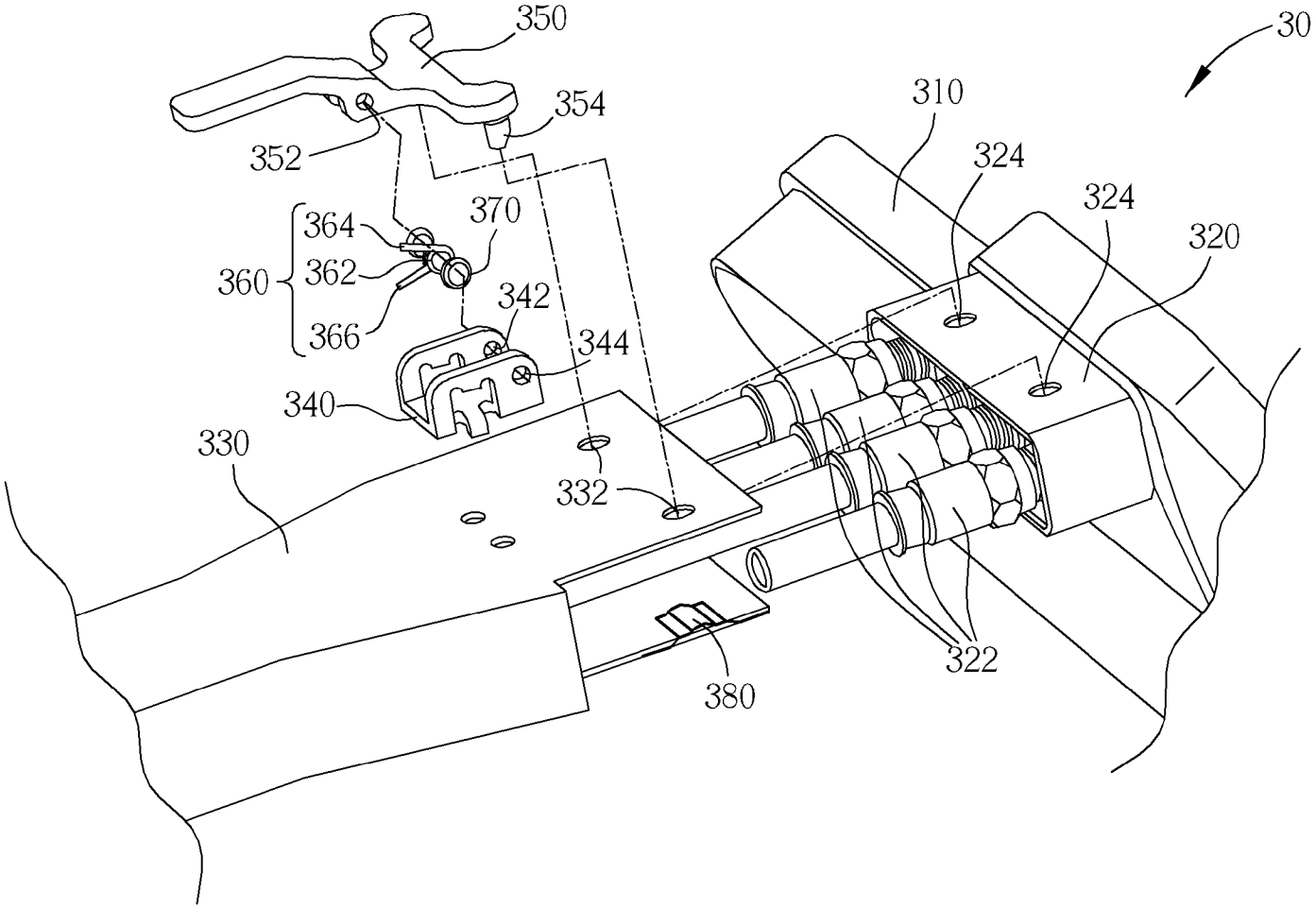
FIG. 12 is an exploded diagram of an LNBF having fixing spring pieces according to an embodiment of the invention.
Figure 13:
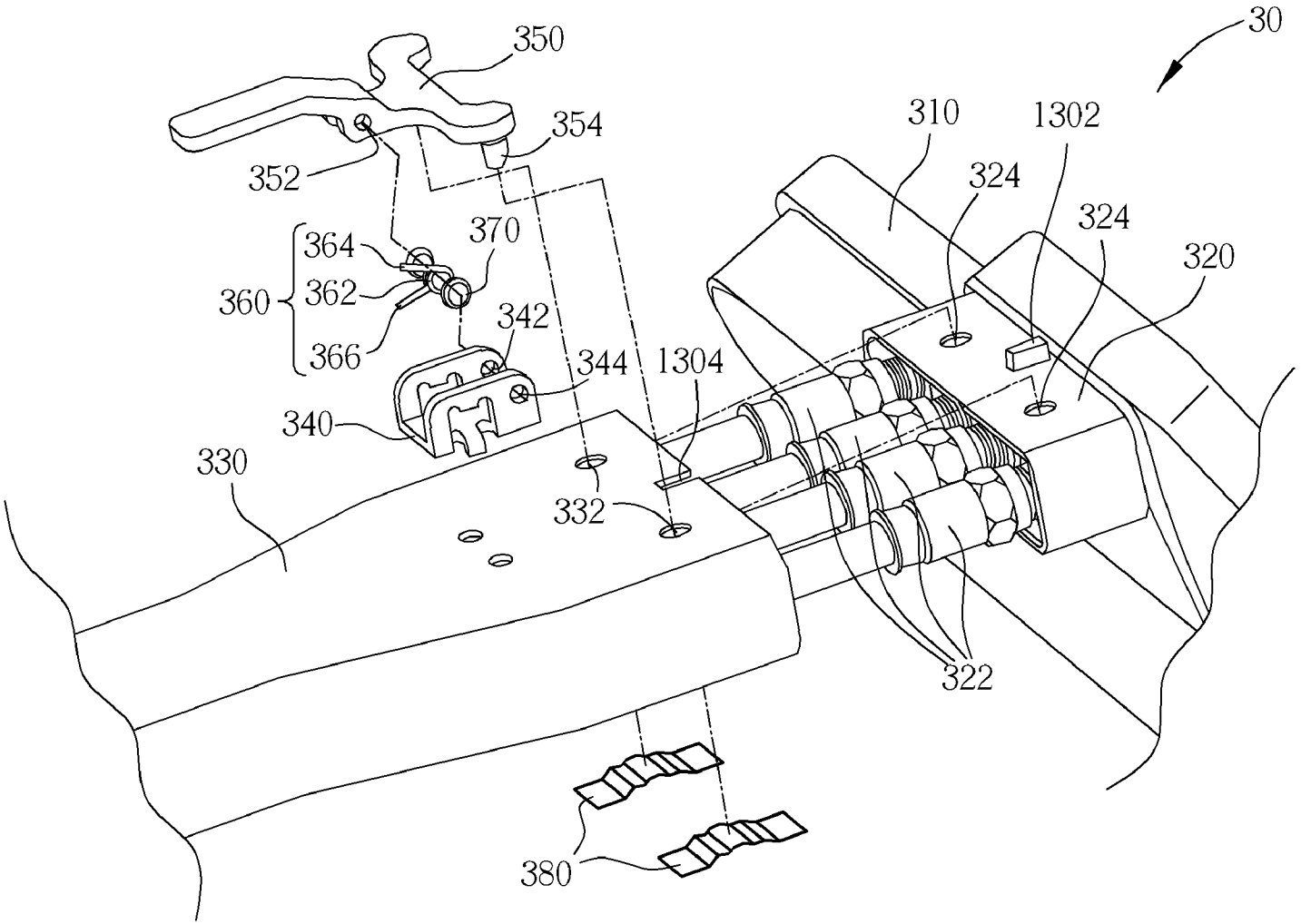
FIG. 13 is an exploded diagram of an LNBF having pilot structure design according to an embodiment of the invention.

Note that, the LNBF 30, 60, and 90 are exemplary embodiments of the invention, and those skilled in the art can make alternations and modifications accordingly. For example, any shape or material of the LNBF main body 310, the connection portion 320, and the support arm 330 is suitable, such as circular tube shaped, square tube shaped, or any shape. Each of the components of the LNBF can also be made of different materials, such as the LNBF main body 310 made of iron material, and the support arm 330 made of aluminum material. In addition, in the embodiment, the invention utilizes 2 sets of locating protrusions (or elastic tenons), the corresponding support arm locating hole 332 and the corresponding LNBF locating hole 324 respectively, and this should not be a limitation of the invention. The fixing spring pieces 380 can be any apparatus having elastic restoring force and fixed in the chamber 334 of the support arm 330 with soldering or rivet joint method. Besides, as shown in FIG. 12, the fixing spring piece 380 and the support arm 330 can be monolithically formed, and the fixing spring piece 380 can be realized in a concave structure having elastic restoring force on a lateral wall of the chamber 334. On the other hand, as shown in FIG. 13, a pilot structure is designed for improving assembly speed. For example, the connection portion 320 includes a pilot protruding portion 1302 and the support arm 330 includes a pilot slot 1304 for assisting with locating during assembly, which should not be a limitation, and those skilled in the art can make alternations and modifications accordingly.

In summary, compared with the prior art, the invention provides assembly and disassembly of an LNBF rapidly and securely via simple operation without any tools. The invention also utilizes the fixing spring pieces to reduce the gap between the components, so that the invention not only avoids a complicated lockup process, but also achieves the purpose of quick and accurate assembly.

Those skilled in the art will readily observe that numerous modifications and alterations of the device and method may be made while retaining the teachings of the invention.

What is claimed is:

1. A low noise block down-converter with integrated feed (LNBF) capable of being quickly assembled, comprising:

an LNBF main body;

a connection portion extending from the LNBF main body, wherein the connection portion comprises a plurality of signal output units and at least one LNBF locating hole;

a support arm comprising at least one support arm locating hole and a chamber capable of accommodating the connection portion for supporting the LNBF main body by connecting with the connection portion;

a holder disposed on the support arm comprising a first holding hole and a second holding hole;

an auxiliary shaft comprising a third holding hole and at least one locating protrusion;

a spring comprising a spring body, a first spring arm, and a second spring arm, wherein the first spring arm and the second spring arm are connected to the auxiliary shaft and the holder respectively; and a pivot for connecting the auxiliary shaft and the spring to the holder by passing through the first holding hole, the second holding hole, the third holding hole, and the spring body;

wherein when the connection portion inserts into the chamber of the support arm, the at least one locating protrusion passes the at least one support arm locating hole and the at least one LNBF locating hole to fix relative position between the connection portion and the support arm, and the spring positions the at least one locating protrusion in an engaging state with elastic restoring force.

2. The LNBF of claim 1, wherein when the connection portion is being inserted into the chamber of the support arm, the auxiliary shaft is rotated from a first position to a second position by an external force to make the at least one locating protrusion leave the at least one support arm locating hole, and the connection portion inserts into the chamber of the support arm.

3. The LNBF of claim 2, wherein the auxiliary shaft is rotated from the second position to the first position by elastic restoring force of the spring to make the at least one locating protrusion pass through the at least one support arm locating hole and the at least one LNBF locating hole for fixing relative position between the connection portion and the support arm after the external force is removed.

4. The LNBF of claim 1, wherein when the connection portion is being removed from the chamber, the auxiliary shaft is rotated from a first position to a second position by an external force to make the at least one locating protrusion leave the at least one LNBF locating hole, and the connection portion is removed from the chamber of the support arm.

5. The LNBF of claim 1 further comprising at least one fixing spring piece disposed on a lateral wall of the chamber for providing elastic restoring force to the connection portion to fix relative position between the connection portion and the support arm.

6. A low noise block down-converter with integrated feed (LNBF) capable of being quickly assembled, comprising:

an LNBF main body;

a connection portion extending from the LNBF main body, wherein the connection portion comprises a plurality of signal output units and at least one LNBF locating hole;

a support arm comprising at least one support arm locating hole and a chamber capable of accommodating the connection portion for supporting the LNBF main body by connecting with the connection portion;

a holder comprising a first holding hole and a second holding hole;

an operating shaft comprising a first end, a second end, and a third holding hole, wherein the first end forms an eccentric cam and the second end is utilized for rotating the operating shaft;

a pivot for connecting the operating shaft to the holder by passing through the first holding hole, the second holding hole, and the third holding hole; and an active plate disposed between the operating shaft and the support arm for contacting with perimeter of the first end of the operating shaft, wherein the active plate at least one locating protrusion;

wherein when the connection portion is inserted into the chamber of the support arm, the operating shaft is rotated to make the at least one locating protrusion pass the at least one support arm locating hole and the at least one LNBF locating hole to fix relative position between the connection portion and the support arm.

7. The LNBF of claim 6 further comprising:

an elastomer connected between the active plate and the support arm for forcing the active plate away from the support arm through elastic restoring force.

8. The LNBF of claim 6 further comprising:

a protection plate connected between the operating shaft and the active plate for preventing the operating shaft from damaging the active plate while operating.

9. The LNBF of claim 6, wherein when the connection portion is being removed from the chamber of the support arm, the operating shaft is rotated to make the at least one locating protrusion of the active plate leave the at least one LNBF locating hole, and the connection portion is removed from the chamber of the support arm.

10. The LNBF of claim 6 further comprising at least one fixing spring piece disposed on a lateral wall of the chamber for providing elastic restoring force to the connection portion to fix relative position between the connection portion and the support arm.

11. The LNBF of claim 10, wherein the at least one fixing spring piece and the support arm are monolithically formed.

12. The LNBF of claim 6, wherein the holder is a U-shaped holder and the U-shaped holder is formed around the support arm.

13. The LNBF of claim 6, wherein the holder is fixed around the support arm by spot welding or soldering methods.

14. The LNBF of claim 6, wherein the holder and the support arm are monolithically formed.

15. A low noise block down-converter with integrated feed (LNBF) capable of being quickly assembled, comprising:

an LNBF main body;

a connection portion extending from the LNBF main body, wherein the connection portion comprises a plurality of signal output units and at least one LNBF locating hole;

a support arm comprising at least one support arm locating hole and a chamber capable of accommodating the connection portion for supporting the LNBF main body by connecting with the connection portion; and at least one elastic tenon, wherein each of the at least one elastic tenon comprises:

an elastic tenon sleeve comprising an opening;

a tenon elastomer disposed in the elastic tenon sleeve; and a locating tenon disposed in the elastic tenon sleeve and connected to the tenon elastomer;

wherein when the connection portion is inserted into the chamber of the support arm, the at least one elastic tenon passes the at least one support arm locating hole and the at least one LNBF locating hole to fix relative position between the connection portion and the support arm, and the corresponding tenon elastomer positions the at least one elastic tenon in an engaging state with elastic restoring force.

16. The LNBF of claim 15, wherein the locating tenon comprises a protruding portion protruding from the elastic tenon sleeve through the opening, and a position-limiting portion for preventing the locating tenon from leaving the corresponding elastic tenon sleeve.

17. The LNBF of claim 15, wherein when the connection portion is being inserted into the chamber of the support arm, the locating tenon is set into the elastic tenon sleeve by an external force, and the connection portion is inserted into the chamber of the support arm.

18. The LNBF of claim 17, wherein after the external force is removed, the locating tenon protrudes from the elastic tenon sleeve through the opening by elastic restoring force of the tenon elastomer and passes through the at least one support arm locating hole and the at least one LNBF locating hole for fixing relative position between the connection portion and the support arm.

19. The LNBF of claim 15, wherein when the connection portion is being removed from the chamber of the support arm, the locating tenon is set into the elastic tenon sleeve by an external force to make the elastic tenon leave the at least one LNBF locating hole, and the connection portion is removed from the chamber of the support arm.

20. The LNBF of claim 15 further comprising at least one fixing spring piece disposed on a lateral wall of the chamber for providing elastic restoring force to the connection portion to fix relative position between the connection portion and the support arm.

* * * * *